United States Patent [19]

Kamogawa et al.

[11] 4,386,844

[45] Jun. 7, 1983

[54] TWO-CYCLE ELECTROPHOTOGRAPHIC COPYING APPARATUS IN WHICH A CLEANING LAMP AND A NEUTRALIZING ELECTRODE ARE DISPOSED ON OPPOSITE SIDES OF AN ELECTRIC CHARGING DEVICE

[75] Inventors: Nin-ichi Kamogawa; Tadashi Umezawa; Masakazu Fukuchi, all of Hachioji, Japan

[73] Assignee: Konishiroku Photo Industry Co., Ltd.

[21] Appl. No.: 122,709

[22] Filed: Feb. 19, 1980

[30] Foreign Application Priority Data

Feb. 20, 1979 [JP] Japan ..... 54/18768

[51] Int. Cl.[3] ..... G03G 21/00

[52] U.S. Cl. ..... 355/15; 118/652

[58] Field of Search ..... 355/15, 3 R, 11, 66, 355/3 CH; 118/652

[56] References Cited

U.S. PATENT DOCUMENTS

| | | | |
|---|---|---|---|
| 3,960,446 | 6/1976 | Ogawa et al. | 355/13 |
| 4,201,465 | 5/1980 | Oyama et al. | 355/15 |
| 4,205,912 | 6/1980 | Yamaguchi et al. | 355/15 |

*Primary Examiner*—R. L. Moses

*Attorney, Agent, or Firm*—Bierman, Bierman & Peroff

[57] ABSTRACT

A two cycle electrophotographic copying apparatus includes an operatively rotatable photosensitive body, an electric charging device, a cleaning lamp disposed upstream of the charging device, and a neutralizing electrode disposed downstream of the charging device. This novel arrangement of the cleaning lamp and neutralizing electrode results in a significantly reduced occurrence of toner contamination by residual electric field attraction to operating and structural portions of the copying apparatus which are positioned about the photosensitive body.

5 Claims, 10 Drawing Figures

TWO-CYCLE ELECTROPHOTOGRAPHIC COPYING APPARATUS IN WHICH A CLEANING LAMP AND A NEUTRALIZING ELECTRODE ARE DISPOSED ON OPPOSITE SIDES OF AN ELECTRIC CHARGING DEVICE

BACKGROUND OF THE INVENTION

1. Field of the Invention

This invention relates to an electrophotographic copying apparatus, and particularly to an electrophotographic copying apparatus of the two-cycle system in which a drum-like photosensitive member, for example, is rotated through two revolutions in each copying operation.

2. Description of the Prior Art

Two methods of forming a copying image by making use of the process of electrophotography are generally known. One method produces a copying image by forming an electrostatic latent image on a sheet-like photosensitive body having a photoconductive layer, such as of ZnO or the like, developing the image with a developer including toner particles as per se well known, and then fixing the image. The other method includes forming an electrostatic latent image on a photosensitive drum, transferring a toner image onto a transfer paper after development of the latent image by toner, and then fixing this transferred image.

This invention relates to an electrophotographic copying apparatus that forms a copying image by making use of the latter method.

Because in this latter method plain paper can be used as transfer paper, and the transfer paper is light in weight and easy to handle even in multicopying, and further since a multitude of copies can be made at high speed and in a short time, this latter method is being widely put to practical use.

On the other hand, in order to continually produce satisfactory copies with repeated operations of the copying apparatus, it is necessary to restore its electrophotographic capability close to the original conditions by utilizing a cleaning means on each copying operation. Determining these conditions and implementing the cleaning operation are some of the most difficult problems presented in designing a copying apparatus.

In normal operation a toner image formed on the photosensitive body in accordance with a respective electrostatic latent image is not transferred entirely onto the transfer paper from the body; a part of the toner image is always undesireably left behind. Since this remaining or residual toner retains an electric charge and therefore adheres to the photosensitive body through electrical as well as physical coupling, simple mechanical cleaning alone is not sufficient to clean the photosensitive body. As a consequence, a preliminary treatment—such as neutralization by an electric neutralizer—becomes necessary. Furthermore, because an afterimage of the electrostatic latent image—which interferes with residual toner cleaning and, at the same time, lowers the quality of subsequently formed images—remains on the photosensitive body, it becomes necessary to eliminate this afterimage by, for example, the operative flash of a cleaning lamp.

However, even if the electrophotographic capability could be fully restored by the influence of a cleaning lamp, an electric neutralizer and a cleaning device, the cleaning device for residual toner has itself many problems associated with its use. For one thing, the surface of the photosensitive body is easily—and hence apt to be—damaged by an external force such as that associated with mechanical cleaning devices. Moreover, the extreme light weight of the residual toner renders it capable of ready scattering within the copying apparatus as a result of which components operable in forming an image—such as the discharge electrodes of a charging device and an image transferring device—are easily contaminated by the scattered toner and the copying capabilities of the apparatus are seriously diminished.

In addition, the material commonly used as a cleaning material is an animal hair or an artificial hair, the mechanical durability of which is short, and such hair of a stable nature is difficult to obtain and to process. The physical characteristics of a cleaning device also present limitations in machine design by occupying a large space in the copying apparatus, producing vibration and noise because of its high speed operation, and reducing durability of the apparatus, further lowering copy-image quality. Still further, the residual toner recovery operation, which is obtained by cleaning, is not easy to accomplish. Thus, there are many hard problems as yet unsolved.

Therefore, a proposal for a two rotation type electrophotographic copying apparatus (or an electrophotographic copying apparatus of the two-cycle system) was made as a possible solution to some of the above-mentioned problems. In this copying apparatus, a variety of operations such as charging, exposing, and developing are sequentially carried out on a photosensitive body and then a copy-image is formed in the first rotation of the photosensitive body. Preliminary operations or processes, such as the lighting of a cleaning lamp, electric corona discharging for removing or neutralizing charges remaining on the photosensitive body and on residual toner particles remaining on the body, and cleaning, are carried out during the second rotation and, preferably, the cleaning is performed by a toner developing device used in the developing process. Of course, the transferring process is carried out while the photosensitive body is rotated through its first cycle.

Thus, it becomes unnecessary to provide the copying apparatus with a separate cleaning device, noise and vibration are significantly reduced, and it further becomes possible to design a relatively compact copying apparatus.

And, as for the preliminary processing and cleaning devices of the two rotation type copying apparatus, such electrophotographic apparatus currently in use conventionally include a preliminary processing device comprising a cleaning lamp and an electric neutralizer arranged either in front (upstream) of or behind (downstream of) an electric charger.

However, such a two rotation type electrophotographic copying apparatus has a number of impediments, such as adherence of toner to equipment parts provided around the drum-type photosensitive member with increases in copying operation. This toner contamination occurs especially to the electric charger or corona charging device V (FIG. 4) and to other equipment parts used for other purposes and arranged adjacent to the electric charging device—as, for example, an anti-dew condensation plate (reference symbol 21 in FIG. 4 or M in FIGS. 2 and 7A for the photosensitive surface. In addition, toner drops onto and contaminates the photosensitive body and, should such plate be touched by an operator in changing the photosensitive body, the toner particles adhere to and contaminate the operator's hands and clothes.

SUMMARY OF THE INVENTION

An object of this invention is accordingly to provide an electrophotographic copying apparatus that protects against shortening of the life of an electric charger and against toner contamination of objects around the photosensitive body, all as caused by the inconvenience of preliminary processing for purposes of cleaning the surface of the body.

Another object of this invention is to provide an electrophotographic copying apparatus that does not require a conventional high speed operated cleaning device, and that consequently protects against machine vibration, noise and disorder of an image.

A further object of this invention is to provide an electrophotographic copying apparatus that protects against damage of the copying apparatus even in high speed multi-copying, and that is able to obtain copies of consistently superior quality.

The above-mentioned objects are achieved in accordance with the invention by positioning a cleaning lamp or illuminating device and an electric nuetralizing device at predetermined positions surrounding a photosensitive body of a two rotation or two cycle electrophotographic copying apparatus; during the first rotation, the surface of the photosensitive body receives a variety of processes—electric charging, exposing, developing, transferring, and separating processes are carried out in that order—and, during the second rotation, the photosensitive body receives a preliminary process for eliminating or neutralizing the charge remaining on the body and on residual toner and a cleaning process, as a result of which the photosensitive body is prepared for the next succeeding copying operation. In accordance with the invention, the cleaning lamp is placed between a separating device and an electric charging device, and the electric neutralizing device is placed between the electric charging device and a cleaning device.

The material to be principally utilized for purposes of development in this invention is magnetic toner, of which there are both electrically conductive and electrically insulative magnetic toners, and either one may be used. In addition, a corona discharging device is preferably used as an electric charging device, the transferring device, the electric neutralizing device, and so on; and, more particularly, an A.C. corona discharging device is preferably used as the electric neutralizing device. And as for a cleaning device—that is, in addition to a developing device—the apparatus may be provided with a magnetic brush cleaning device or a web-cleaning device or the like, although it is preferable from an economic point of view to use the developing device for both development and cleaning. More particularly, it is a highly suited and beneficial factor that toner recovered from the cleaning device can be used directly for developing, since magnetic toner is utilized as the developing material in practicing the invention.

Although the present invention is described through the following example, it is to be understood that the disclosed embodiment is not intended to limit the scope of the invention specifically thereto.

The construction illustrated in FIG. 4 is similar to that of a conventional electrophotographic copying apparatus without the herein disclosed and there shown arrangement of a cleaning lamp 18 and an electric neutralizing device 19 as previously mentioned.

In the disclosed example, zinc oxide photosensitive paper is prepared by dispersing a photoconductive zinc oxide (hereinafter referred to as zinc oxide) in a binding resin to form the photosensitive body, and an electrically insulative magnetic toner is used as the developing agent. The electrically insulative toner disclosed in U.S. patent applications Ser. No. 832,019 (a divisional application of U.S. Ser. No. 608,274, now abandoned) and Ser. No. 25,783 (a continuation of U.S. Ser. No. 829,795, now abandoned) can be used in the copying machine according to this invention.

DETAILED DESCRIPTION OF THE PREFERRED EMBODIMENT

Figure 3:
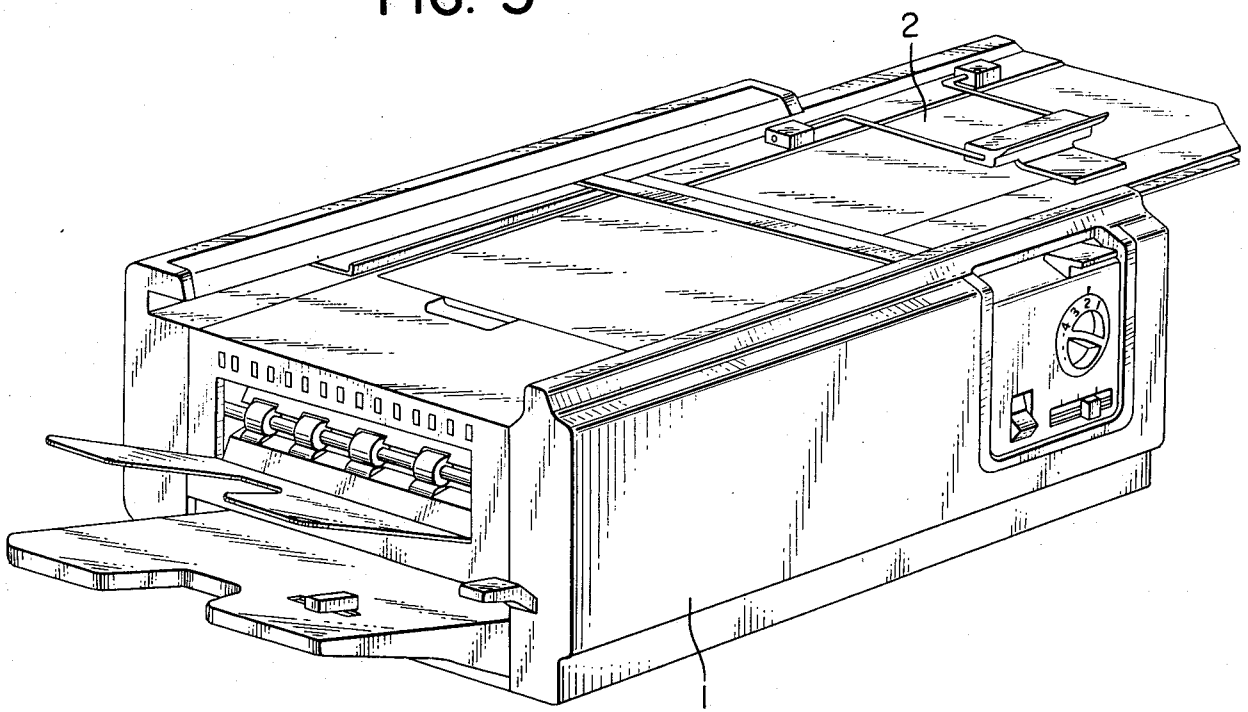
FIG. 3 is an elevated perspective view of an electrophotographic copying apparatus in which the present invention is incorporated.
Figure 4:
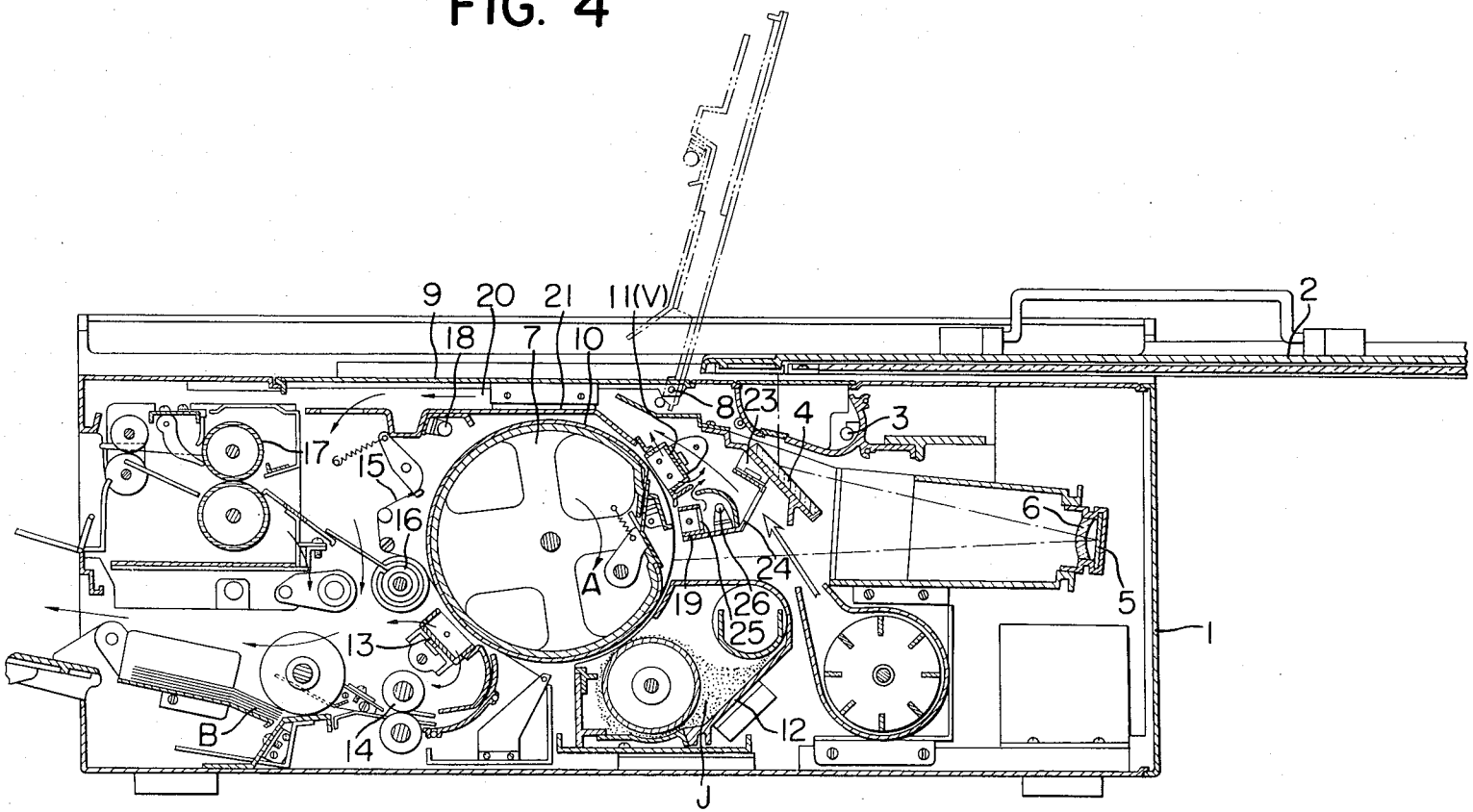
FIG. 4 is a cross-sectional side view of the copying apparatus of FIG. 3.

In FIGS. 3 and 4, a reciprocating copy board 2 is installed atop machine body 1, a lamp 3 for exposure within machine body 1 is positioned directly below copy board 2, and an image of an original, which is lighted by lamp 3, is projected on the cylindrical surface of photosensitive drum 7 through an optical system including mirrors 4 and 5 and lens 6.

The photosensitive drum 7 rotates twice during every copying operation in the direction shown by reference arrow A; during the first rotation, the processes of electric charging, image exposure, development, transfer, and separation are carried out, and during the successive second rotation, preliminary processing and cleaning are effected. Mounted circumferentially about the cylindrical surface of drum 7 is a zinc oxide sheet 10, removably changeable by opening cover 9 which is supported by pivot 8 atop machine body 1.

On the outer surface of photosensitive drum 7, negative corona charging device 11, cleaning and developing device 12 (comprising a magnetic brush), and transferring electrode 13 are so arranged that each is stationarily fixed with respect to machine body 1, and each successively adjoins the next as viewed in the direction depicted by arrow A. Thus, during the first rotation of photosensitive drum 7, negative ions adhere to and then charge the entire surface of the photosensitive layer 10 through discharge from electric charging device 11, and a negative electrostatic latent image corresponding to the original to be copied is formed on the surface of the photosensitive layer through a conventional exposure process.

Next, the electrostatic latent image on the photosensitive layer 10 is developed and a toner image thereby formed as the layer passes through developing device 12 which contains magnetic toner J. The toner image is then brought into contact with a sheet of transfer paper B—which is supplied from paper feeding device 14—as it passes through and by the action of transferring electrode 13. The transfer paper B retaining the toner image is next separated from the surface of photosensitive drum 7 by the separating device comprising tension wire 15 and separating roller 19, and the toner image on the paper is fixed thereon by fixing device 17; finally, transfer paper B is exhausted from the machine to a paper receiving tray (no reference symbol).

Figure 5:
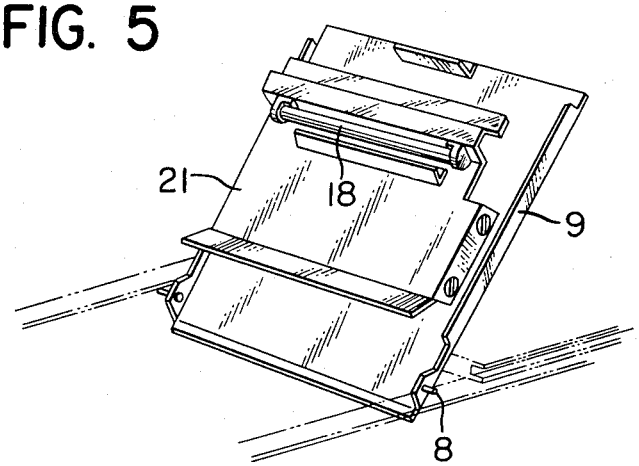
FIG. 5 is an elevated perspective view of the portion of the apparatus about the cleaning lamp.

Cleaning lamp 18 and neutralizing electrode 19 are arranged along the outer surface of photosensitive drum 7 in the positions characterized by this invention. That is—as shown in FIG. 4—cleaning lamp 18 is arranged between separating device 15, 16 and electric charging device 11 fixed underneath the left end or partition plate 21 (see also FIG. 5). The plate 21 is disposed to protect drum 7 from accumulation thereon of dew by covering the upper portion of the photosensitive drum. Partition plate 21 additionally forms, in cooperation with open and shut cover 9, an exhaust passage 20 for the air flow generated during the copying operation.

Figure 6:
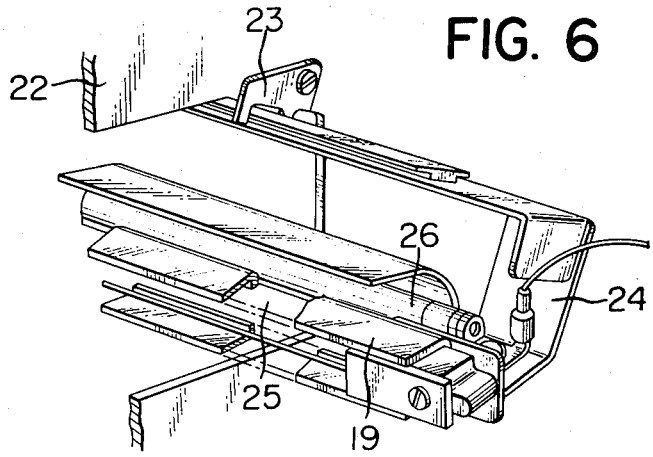
FIG. 6 is an elevated perspective view of the portion of the apparatus about the neutralizing electrode.

In accordance with the invention, the neutralizing device or electrode 19 is positioned between electric charging device 11 and developing device 12 as shown in FIG. 4, and is supported at a nose of arm 24 which is inserted into the apparatus by sliding into guide rail 23 fixed to machine frame 22 as seen in FIG. 6. Neutralizing device 19 is connected to a source of electric power (not shown) having a discharging voltage of reverse polarity with respect to the charge of toner or A.C. discharging voltage. A window 25 is provided adjacent the back surface of neutralizing electrode 19, and a supplementary lamp 26 is positioned at the rear of window 25; however, the provision of supplementary lamp 26 is not essential to the invention.

This invention has various points of advantage which are best understood and most readily explained by comparison with the conventional technologies in which the preliminary processing devices are arranged either in front of or behind the electric charging device.

Thus, two situations must be examined with respect to conventional techniques—one in which the preliminary processing devices are located in front (or upstream) of the electric charging device, and the other where said preliminary processing devices are disposed behind or downstream of the charging device. Study of each such situation by the present inventors has resulted in the followed understanding of the aforementioned problems in an apparatus utilizing magnetic toner (commonly referred to as single component developer). The first situation discussed concerns a copying apparatus in which the preliminary processing devices—i.e. the cleaning lamp and the neutralizing device—are both disposed in front or upstream of an electric charging device 11 when viewed in the direction of drum rotation, and reference is now made to FIG. 1 in conjunction with FIG. 4.

Figure 1A:
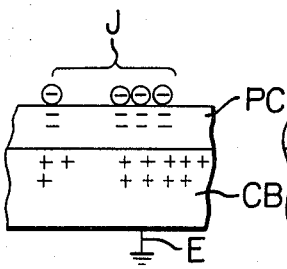
FIGS. 1A–C and 2 are diagrammatic, explanatory illustrations of conventional preliminary processing before cleaning.

A photosensitive layer PC having a negative electrostatic latent image impressed thereon is developed with toner having a reverse polarity, by which a toner image having positive electric charge is formed. When the developed layer subsequently passes through a transfer process, the greater part of the toner image is transferred onto a transfer paper by action of a negative electric discharging field of the transferring electrode. However, as shown in FIG. 1A, a portoion of toner J always remains on photosensitive layer PC and such remaining or residual toner becomes negatively charged under the influence of ionization caused by negative discharge of the transferring electrode.

Figure 1B:
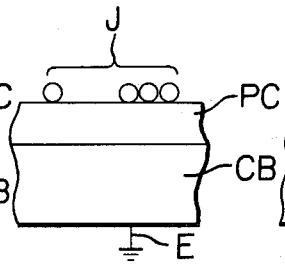

When photosensitive layer PC retaining the negatively charged residual toner J passes through a preliminary process, a residual latent image remaining on layer PC is eliminated by the lighting of a cleaning lamp, and the charge on the residual toner J is eliminated through discharge of an electric neutralizing device, as shown in FIG. 1B.

Figure 1C:
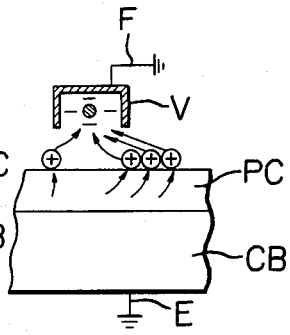

Referring now to FIG. 1C, photosensitive layer PC—which retains thereon neutralized residual toner J—thereafter passes underneath electric charging device V which, although out of operation at that time, retains a negative electric potential in, for example, its wire electrode (no reference symbol) as a result of residual electric potential of the high voltage electric power source (not shown) previously applied thereto. As a consequence, positive electric charge is injected from photosensitive layer PC into an electroconductive portion of the residual magnetic toner J by action of its electric field. It will be understood that magnetic toner now bearing a positive charge is attracted and adheres to the wire electrode of charging device V through action of the negative electric field of the electrode of charging device V. As a result, the wire electrode of electric charging device V is contaminated by toner particles.

Although electric charging device V is, in general, formed having several lines of electric discharging wires (which are made of tungsten and tightly stretched between both ends of an insulative supporting plate fixed to an electroconductive shield), once the wire electrode is contaminated by toner powder J or by charged foreign matter, its efficiency of electric discharge is significantly lessened. Even if only a relatively few particles of toner powder J adhere to an electric discharging wire, a portion thereof surely produces difficulty of electric discharging and immediately and seriously affects image quality. Therefore, contamination of electric charging device V by toner J brings about a significant lapse in its operating capability.

The second conventional situation or arrangement, wherein the preliminary processing devices are disposed behind or downstream of an electric charging device 11, will now be discussed with particular reference to FIG. 2 in conjunction with FIG. 4.

Photosensitive layer PC retaining residual toner J is transported toward electrical charging device V with the electric charging arrangement shown in FIG. 1A. Where an electroconductive shielding plate and so on exists adjacent the photosensitive drum during the process, an anti-dew condensation plate M and the like for the photosensitive body are often arranged; in such case, positive electric charge is caused to collect on anti-dew condensation plate M by action of the negatively charged electric field of photosensitive layer PC.

Thus, by action of said electric field acting on anti-dew condensation plate M, the negatively charged toner J is attracted and adheres to the underside of plate M, and sometimes toner J drops therefrom onto the photosensitive body due to machine vibration or the like, lowering the quality of an image formed on photosensitive layer PC. Moreover, where the plate M is susceptible to being touched by an operator in changing the photosensitive body, toner contaminates the operator's hands and clothes.

The preceding background discussion of the prior art conventional apparatus should facilitate an understanding and appreciation of the following description of the advantages presented by the teachings of the present invention, by which the aforementioned obstacles are eliminated.

Figure 7A:
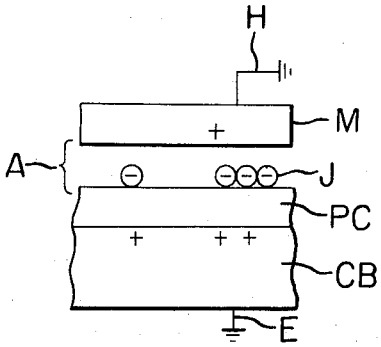
FIGS. 7A–B are diagrammatic, explanatory illustrations similar to those of FIG. 1 and showing preliminary processing prior to cleaning in accordance with the present invention.

FIG. 7A illustrates the arrangement of charge at the stage in which photosensitive layer PC is disposed just beneath anti-dew condensation plate M (reference numeral 21 in FIG. 4) or electrically conductive member M placed closely to the photosensitive surface. The residual charge on photosensitive layer PC of body 7 has been neutralized by prior passage past cleaning lamp 18 following the developing and transferring processes during the second rotation of body 7. Positive charges equivalent to the negative charge of the residual toner alone are distributed and accumulated on conductive layer CB of the photosensitive body and on anti-dew condensation plate M in proportion to their capacitance. That is, positive charges are accumulated corresponding to the capacitance ($C_1$) of the photosensitive body and the capacitance ($C_2$) of photosensitive layer PC—through air gap A—with anti-dew condensation plate M.

Figure 2:
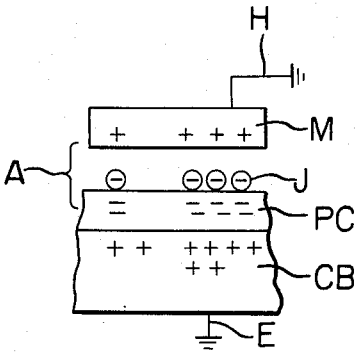

Therefore, in the present stage in which the holding or residual charge of photosensitive layer PC has been neutralized, the positive charge induced on anti-dew condensation plate M is much reduced compared with the previously discussed conventional case illustrated in FIG. 2. As a consequence, the force present to attract toner J through the effect of the electric field generated by such induced positive charge is extremely small and the anti-dew condensation plate does not become contaminated by toner J.

Figure 7B:
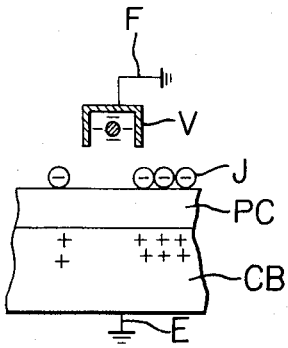

On the other hand, even when the residual toner J arrives at the point directly under electric charging device V as shown in FIG. 7B, the negative charge retained by electric charging device V repels the toner particles because these toner particles J are also negatively charged. The residual toner J is not attracted and does not therefore adhere to electric charging device V and the notable decrease in its operating performance otherwise resulting from contamination does not occur. After passage beyond or downstream of charging device V the negative charge of residual toner J is neutralized by action of electric neutralizing device 19 and the toner is subsequently removed from photosensitive layer PC by means of cleaning-developing device 12.

Thus, with the present invention, the objects or structures around the photosensitive body are not contaminated by toner and the life of the electric charging device that plays an important role in the operation of the copying machine is extended. Furthermore, the life of the copying machine is correspondingly extended and stable copied images are consistently offered.

What is claimed is:

1. In an improved two-cycle electrophotographic copying apparatus including an operatively rotatable photosensitive body, and in which electric charging means, exposing means, transferring means, and separating means are respectively sequentially disposed about the body in the direction of its rotation for operation during a first rotation of the body to produce a toner-based copied image of an original, while cleaning of residual toner from the photosensitive body is effected during a second rotation thereof to prepare the body for a next succeeding copying operation, the improvement comprising:

preliminary processing means for preparing the body for subsequent cleaning during the second rotation thereof, and comprising a cleaning lamp disposed upstream of the electric charging means and downstream of the transferring means for operatively discharging the photosensitive body of residual electric charge remaining thereon after production of the copied image and thereby facilitating subsequent cleaning of the photosensitive body during its second rotation, and a neutralizing electrode disposed downstream of the electric charging means for neutralizing electric charge on residual toner remaining on the photosensitive drum after production of the copied image.

2. In an improved two-cycle electrophotographic copying apparatus according to claim 1, the apparatus further including an anti-dew condensation plate disposed adjacent the photosensitive drum and between the electric charging means and said cleaning lamp.

3. In an improved two-cycle electrophotographic copying apparatus according to claim 1 or 2 and further including a developing means operable during the first rotation of the photosensitive body and disposed between the electric charging means and the transferring means, said cleaning lamp being disposed between the electric charging means and the separating means, and said neutralizing electrode being disposed between the electric charging means and the developing means.

4. In an improved two-cycle electrophotographic copying apparatus according to claim 1 or 2, in which the developing means functions during the second rotation of the photosensitive body as a means for cleaning the electrically discharged surface of the body of charge neutralized residual toner remaining thereon after production of the copied image during the first rotation of the body, the developing means comprising a magnetic brush.

5. In an improved two-cycle electrophotographic copying apparatus according to claim 3, in which the developing means functions during the second rotation of the photosensitive body as a means for cleaning the electrically discharged surface of the body of charge neutralized residual toner remaining thereon after production of the copied image during the first rotation of the body, the developing means comprising a magnetic brush.

* * * * *